US012653326B2

(12) United States Patent
Armatys et al.

(10) Patent No.: US 12,653,326 B2
(45) Date of Patent: Jun. 16, 2026

(54) POCKETED SPRINGS ASSEMBLY, MATTRESS AND POCKETED SPRINGS ASSEMBLY MANUFACTURING METHOD

(71) Applicant: Sleep Brands Limited, London (GB)

(72) Inventors: Patryk Armatys, Grabow nad Prosna (PL); Adam Wirt, Nowe (PL)

(73) Assignee: Sleep Brands Limited, London (GB)

( * ) Notice: Subject to any disclaimer, the term of this patent is extended or adjusted under 35 U.S.C. 154(b) by 87 days.

(21) Appl. No.: 18/903,847

(22) Filed: Oct. 1, 2024

(65) Prior Publication Data

US 2025/0107635 A1 Apr. 3, 2025

(30) Foreign Application Priority Data

Oct. 2, 2023 (PL) ..... 446291

(51) Int. Cl.
*A47C 27/07* (2006.01)
*A47C 27/045* (2006.01)
*A47C 27/06* (2006.01)

(52) U.S. Cl.
CPC ..... *A47C 27/07* (2013.01); *A47C 27/045* (2013.01); *A47C 27/062* (2013.01); *A47C 27/064* (2013.01)

(58) Field of Classification Search
CPC ..... A47C 27/07; A47C 27/045; A47C 27/062; A47C 27/064; A47C 27/066; A47C 23/04
See application file for complete search history.

(56) References Cited

U.S. PATENT DOCUMENTS

| | | | | |
|---|---|---|---|---|
| 6,813,791 | B2 * | 11/2004 | Mossbeck | A47C 27/064 5/727 |
| 10,206,515 | B1 * | 2/2019 | Jewett | A47C 27/064 |
| 2003/0177585 | A1 * | 9/2003 | Gladney | A47C 27/14 5/717 |
| 2019/0380502 | A1 * | 12/2019 | Eigenmann | B68G 7/00 |
| 2021/0045540 | A1 * | 2/2021 | Jewett | A47C 27/064 |
| 2025/0107632 | A1 * | 4/2025 | Armatys | A47C 27/045 |

FOREIGN PATENT DOCUMENTS

| | | | |
|---|---|---|---|
| DE | 4031654 | A1 | 4/1992 |
| WO | 2018/224139 | A1 | 12/2018 |

* cited by examiner

*Primary Examiner* — J. T. Newton

(74) *Attorney, Agent, or Firm* — Merchant & Gould P.C.

(57) ABSTRACT

A pocket spring assembly 1 includes a core 1' of a pocket spring assembly formed by a plurality of adjacent first pocket spring webs 2 and at least one second pocket spring web 4 attached to the core. Additional strips (6) are provided connecting the at least one pocket spring web 2 with the first layer (3), while on the other side the pocket spring webs 4 are attached to the extending parts of the textile layer. The layers 3,3' are attached to the core 1'. A mattress contains a pocket spring assembly and a method is for manufacturing such an assembly.

10 Claims, 7 Drawing Sheets

POCKETED SPRINGS ASSEMBLY, MATTRESS AND POCKETED SPRINGS ASSEMBLY MANUFACTURING METHOD

The object of the invention is a pocket spring assembly having at least one stiffened edge of the assembly. The invention also relates to a mattress comprising such an assembly, as well as to a method of manufacturing of the pocket spring assembly.

The present invention belongs to the field of mattresses comprising a pocket spring assembly. Such pocket spring assemblies, also referred to in the industry as innersprings, are formed by a plurality of coil springs which are enclosed in pockets of textile material, each spring being placed in an individual pocket, the adjacent pockets forming pocket springs strings, also referred to as pocket springs webs, the said pocket springs webs being connected side to side to form a pocket spring assembly which can serve as a mattress layer in a mattress.

One of the important technical problems in the design of pocket spring assemblies is to ensure that the edges of such assemblies are stiffened. A number of solutions can be found in the state of the art, which are based on a suitable adjustment of the parameters of the spring elements at the edge of the assembly, e.g. through a suitable selection of the wire thickness or the number of spring coils or the hardness of the foam from which the blocks constituting the spring element in the assembly of pocket spring elements are made. One known solution is also to pack the springs more densely in the edge area of the mattress layer, as for example disclosed in publication DE 40 31 654 A1.

In another solution, the springs to form a stiffened border are placed in the intermediate space created between two springs of an adjacent row of pocket springs.

Still another approach is proposed in publication WO2018/224139A1, which discloses a method of manufacturing a pocket spring assembly having an edge with springs having different stiffness characteristics compared to the springs of the core of the assembly. The disclosed method comprises the step of providing a core (body) of the pocket spring assembly comprising a plurality of first webs (or strings) of pocket springs, followed by the step of attaching at least one second pocket springs web to a lateral surface of said core of the pocket spring assembly, so that at least one second pocket springs web extends (runs) in the longitudinal direction of the core of the pocket spring assembly. The springs of at least one second pocket springs web have spring characteristics or spring geometry different from the springs in the first webs forming the core of the pocket spring assembly. At least one second pocket springs web, when connected, forms a pocket spring assembly together with the core. In order to stiffen the longitudinal edges of the assembly, the step of providing the aforementioned core additionally comprises terminating the core at both longitudinal ends with pocket spring webs in which springs with different spring characteristics or geometries are provided compared to the springs contained in the pockets of the first pocket spring webs, forming the core of the pocket spring assembly. This provides stability at the longitudinal ends of the assembly. In an advantageous embodiment of such a pocket spring assembly, the method also comprises attaching at least one second pocket spring web to both the first lateral surface and the second lateral surface of the core of the pocket spring assembly, which, in combination with the stiffening provided by said pocket spring strings provided at the longitudinal core ends, results in the pocket spring assembly thus formed having a stiffened periphery completely surrounding the core built of the first pocket spring webs. The longitudinal core ends or the longitudinal core edges are to be understood here in the context of the core-forming process, which takes place by attaching successive pocket springs webs side by side, parallel to each other. The first pocket springs web, to which the subsequent webs are subsequently attached, and the last one of the attached pocket springs webs provide the longitudinal core ends/longitudinal core edges, and the direction in which the core is built up by attaching the subsequent webs is referred to as the longitudinal direction.

Furthermore, in the method according to the invention described in WO2018/224139A1, providing the main core of the assembly comprises attaching a pair of non-woven layers to the upper and lower surfaces of the core of the pocket spring assembly so that the non-woven sheets cover said core and transversely with respect to the longitudinal direction extend beyond the core, ensuring that the attachment of at least one second pocket springs web to the lateral surface of the core is carried out so that said at least one second web is placed between the pair of non-woven sheets. Furthermore, to achieve the attachment of the at least one web between the non-woven sheets, the method comprises holding the non-woven sheets by means of a clamping device and pushing said at least one second pocket springs web by means of a pusher between the non-woven sheets to the lateral surface of the core. The method also comprises compressing the springs of at least one second pocket springs web before attaching at least one second pocket spring to the core of the assembly, and allowing the compressed webs to relax when attached to the side surface of the core of the assembly. This step ensures that the second web adheres well to the non-woven sheets, as the adhesive is pressed against the upper and lower non-woven sheets due to the relaxation of the previously compressed springs.

The described solutions from the state of the art are quite complex in the context of manufacturing the described pocket spring assemblies. Furthermore, although the presented known solutions make it possible to ensure edge stability/stiffening, the implementation of the mentioned solutions in practice involves significant and costly modifications to already existing production lines, which are usually based on conventional spring assembly machines producing spring assemblies from continuous (so-called endless) pocket springs webs, in which all springs have the same or very similar elastic properties. The attachment of the stiffening spring webs to the longitudinal ends of the assembly can easily be done with the already mentioned conventional spring assembly machines, using technology that is well-known and has been used for years. To this end, one simply provides an additional source of stiffening spring web and ensures that it is attached in a manner analogous to the attachment of the first webs forming the core of the assembly. However, a complex technical problem is presented by providing a means of stiffening the assembly on the sides extending along the longitudinal direction of the core (i.e. in the direction of the attachment of the successive webs to form the core). The realization of such a method by attaching second stiffening web/second stiffening webs attached to the lateral plane of the core and running in its longitudinal direction requires the addition of a new step, necessitating the provision of additional equipment or significant modification of already existing machines in the production line.

The purpose of the present invention is therefore to provide a pocket spring assembly with a stiffened edge, suitable for use in the construction of a mattress, and which can be produced simply and cheaply and at the same time can provide better edge stability compared to solutions known from the state of the art.

This has been achieved by solutions according to the invention, as defined by independent claims. Advantageous embodiments of the invention are defined by the dependent claims.

The object of the invention is a pocket spring assembly comprising:

a plurality of first pocket springs webs, whereby adjacent first pocket springs webs are interconnected to form the core of the pocket spring assembly, a first textile layer and a second textile layer are attached respectively to the first and second surfaces of the core of the pocket spring, at least one second pocket springs web is attached to the first lateral surface of said core of the pocket spring assembly to form a pocket spring assembly, said second pocket springs web extending perpendicularly to the direction of the first pocket springs webs, the springs in the first pocket springs webs having different stiffness characteristics from the springs in said at least one second pocket springs web, wherein the pocket spring assembly according to the invention being characterized in that the pocket spring assembly further comprises a textile strip which is attached to at least one second pocket spring web and to the first textile layer, and a second textile layer has a part extending beyond the core of pocket spring assembly to which part there is attached at least one second pocket spring web.

In an advantageous embodiment of the invention, at least one and preferably two third pocket springs webs are positioned at one of the longitudinal ends of the core of the pocket spring assembly, the springs in said third pocket springs webs having different stiffness characteristics than the springs of the first pocket springs webs.

In another advantageous embodiment of the invention, at least one and more advantageously two third pocket springs webs are positioned at both longitudinal ends of the core of the pocket spring assembly, the springs in said third pocket springs webs having different stiffness characteristics than the springs of the first pocket springs webs.

In yet another advantageous embodiment of the invention, a set of two second pocket springs webs is attached to the first side surface of the pocket spring core, wherein a first textile strip is attached to said set of the two second pocket springs webs and the first layer of the textile sheet and to the part of the second layer of textile material extending beyond the core of pocket spring assembly.

In another advantageous embodiment of the invention, the pocket spring assembly comprises at least one second pocket springs web and advantageously a set of two second pocket springs webs attached to the second lateral surface of the core of the pocket spring assembly, wherein the second layer of textile material comprises second part extending beyond the core of the pocket springs assembly, to which attached is at least one second pocket springs web, and preferably to a set of two second pocket springs webs, attached to the second lateral surface, while the additional second first strip of textile material is attached to at least one second pocket springs web, and preferably to set of the second pocket springs webs, attached to second lateral side and to first layer of textile material.

Also an object of the invention is a mattress comprising a pocket spring assembly, which comprises:

a plurality of first pocket springs webs, whereby adjacent first pocket springs webs are interconnected to form the core of the pocket spring assembly, a first textile layer and a second textile layer are attached respectively to the first and second surfaces of the core of the pocket spring, at least one second pocket springs web is attached to the first lateral surface of said core of the pocket spring assembly to form a pocket spring assembly, said second pocket springs web extending perpendicularly to the direction of the first pocket springs webs, the springs in the first pocket springs webs having different stiffness characteristics from the springs in said at least one second pocket springs web, wherein the pocket spring assembly according to the invention is characterized in that the pocket spring assembly further comprising a textile strip which is attached to at least one second pocket spring web and to the first textile layer, and a second textile layer has a part extending beyond the core of pocket spring assembly to which there is attached at least one second pocket spring web.

In an advantageous embodiment of the mattress according to the invention, in the pocket spring assembly at least one, and more preferably two third pocket spring webs are positioned at one of the longitudinal core ends of the pocket spring assembly, the springs in said third pocket spring webs having different stiffness characteristics than the springs of the first pocket spring bands.

In another advantageous embodiment of the mattress according to the invention, in the pocket spring assembly at least one, and more preferably two third pocket springs webs are positioned at both longitudinal core ends of the pocket spring assembly, wherein the springs in the third pocket springs webs having different stiffness characteristics than the springs of the first pocket springs webs.

In yet another advantageous embodiment of the mattress according to the invention, in the pocket spring assembly a set of two second pocket springs webs is attached to the first lateral surface of the pocket spring core, wherein a first textile strip is attached to said set of the two second pocket springs webs and the first layer of the textile sheet and to the part of the second layer of textile material extending beyond the core of pocket spring assembly.

In another advantageous embodiment of a mattress according to the invention, the pocket spring assembly comprises at least one second pocket springs web, and preferably a set of two second pocket springs webs, attached to a second side surface of the core of the pocket spring assembly, wherein the second layer of textile material have a second extending part beyond the set of the springs to which attached is at least one second spring pockets web, and preferably set of the two second pocket springs webs to second lateral surface, and additional second first textile strip is attached to at least one second pocket springs web, and preferably set of the two second pocket springs web attached to second lateral surface and to first layer of textile material.

Also an object of the invention is a method of manufacturing a pocket spring assembly comprising the steps:

a) providing a core of a pocket spring assembly, said core of the pocket spring assembly comprising a plurality of first pocket springs webs, the adjacent first pocket springs webs being interconnected to form said core of the pocket spring assembly, b) attaching a first layer of textile material and a second layer of textile material to respectively the first and second surfaces of said core of the pocket spring assembly, wherein the first layer of textile material covers the first surface of the pocket spring core and does not extend beyond said area, while the second layer of textile material has a part extending beyond the core of the pocket springs assembly, c) providing at least one second pocket spring web in which the springs have a different spring rate characteristic than the springs in the first pocket spring sheet, wherein, according to the invention, the method is characterized in that it comprises the additional steps of:

d) attaching a textile strip to at least one second pocket springs web in a parallel plane to plane of the first layer of textile material, wherein after attaching said textile strip has an unattached part extending beyond area of attachment to the least one second pocket springs web, e) forming a pocket spring assembly by attaching at least one second pocket spring web obtained in step (d) to a first lateral surface of the core of the pocket spring assembly so that said unattached extending part of the strip of textile material is attached to the first layer of textile material and, on the other side, at least one second pocket spring web is attached to a part of the second layer of textile material extending beyond the core of the pocket spring assembly.

In an advantageous example of the implementation of the method according to the invention, step a) provides a core of the pocket spring assembly with at least one and preferably two third pocket spring webs attached to the outermost pocket spring web at the longitudinal end of the core of the pocket spring assembly, wherein the springs in the third pocket spring web having different stiffness characteristics than the springs in the first pocket spring webs.

In another advantageous example of the implementation of the method according to the invention in step (a), a pocket spring assembly core is provided with at least one and preferably two third pocket spring webs attached to the outermost pocket spring webs at both longitudinal ends of the core of the pocket spring assembly, the springs in the third pocket spring web having different stiffness characteristics than the springs in the first pocket spring webs.

In yet another preferred embodiment of the method according to the invention, in step b) the second layer of textile material has two opposite parts extending beyond the area of the core of the pocket spring assembly, in step e) at least one second pocket spring web, and preferably a set of two second pocket spring webs obtained in accordance with step (d), is additionally attached to a second lateral surface of the core such that said unattached extending portion of the strip of textile material is attached to the first layer of textile material, and on the opposite side at least one second pocket spring web is attached to a portion of the second layer of textile material extending beyond the core of the pocket spring assembly.

The terms used in this description are to be understood in the manner accepted in the technical field of the invention, including description of the state of the art presented above and the state of the art documents cited, unless the description clearly indicates otherwise.

Within the meaning of the invention, the pocket spring assembly comprises a core of the assembly and at least one second pocket springs web connected to the lateral surface of the core and extending in the longitudinal direction of the core, the core of the assembly being formed by a plurality of first pocket springs webs containing springs having different stiffness characteristics from the springs contained in said at least one second pocket springs web connected to the lateral surface of the core. Thus, there are at least two types of webs in the pocket spring assembly, wherein the first webs, containing springs with a first stiffness characteristic, which, connected side to side, form the core of the pocket spring assembly. The longitudinal direction of the core is to be understood as the direction in which the successive webs forming the core are attached to each other, the longitudinal ends of the core being the outermost first webs from which the core of the pocket spring assembly is formed. The core of the pocket spring assembly may also according to the invention comprise at least one and more preferably two third pocket springs webs, which are positioned at both longitudinal ends of the core of the pocket spring assembly and attached to the outermost first webs, the springs in the third of pocket springs webs having different stiffness characteristics than the springs of the first pocket springs webs.

Put together in the design of the pocket spring assembly according to the invention, the coil springs in the first, second and third pocket spring webs differ in their stiffness characteristics and are thus able to provide an assembly with a stiffened edge. It is known to the expert in the field that the stiffness characteristics of the coil springs can be adjusted accordingly, for example by using different spring diameters. Within the meaning of the invention, a helical spring has upper and lower coils and a plurality of central coils between the upper and lower coils, the largest of the diameters of the central coils of the spring being taken as the diameter of the spring within the meaning of the invention. It is known to the expert in the field that by using the same wire thickness, it is possible to achieve different spring stiffness (hardness) by selecting the coil diameter accordingly. Thus, assuming springs are made from the same diameter wire and are of the same spring height, a smaller diameter spring will be harder (stiffer) than a larger diameter spring. In addition, the spring's stiffness is influenced by the number of coils and the wire thickness, with the spring's stiffness increasing as the thickness of the wire from which the spring is made increases, while decreasing the number of coils increases the hardness.

The stiffness of the spring is also influenced by its primary height, understood as the height of the spring before it is placed in the pocket. As the primary height of the spring increases, its stiffness increases. With the above in mind, an expert in the field will easily realize a selection of springs with different stiffness characteristics by adjusting accordingly the above-mentioned parameters of spring construction, in particular the wire diameter, the original height and the diameter and number of spring coils. All parameter combinations known to the expert in the field that ensure different stiffness characteristics of the springs arranged in the first, second and third webs of the pocket spring assembly according to the invention are within the scope of the invention.

A textile material in the sense of the invention includes any textile material providing ability to join webs to form a mattress layer. Examples of such materials are non-woven fabrics, felts, woven fabrics.

The object of the invention is illustrated in more detail in the following description and in the drawing wherein.

All references in the figures showing different embodiments of the invention refer to identical elements of the pocket spring assembly.

Figure 1:
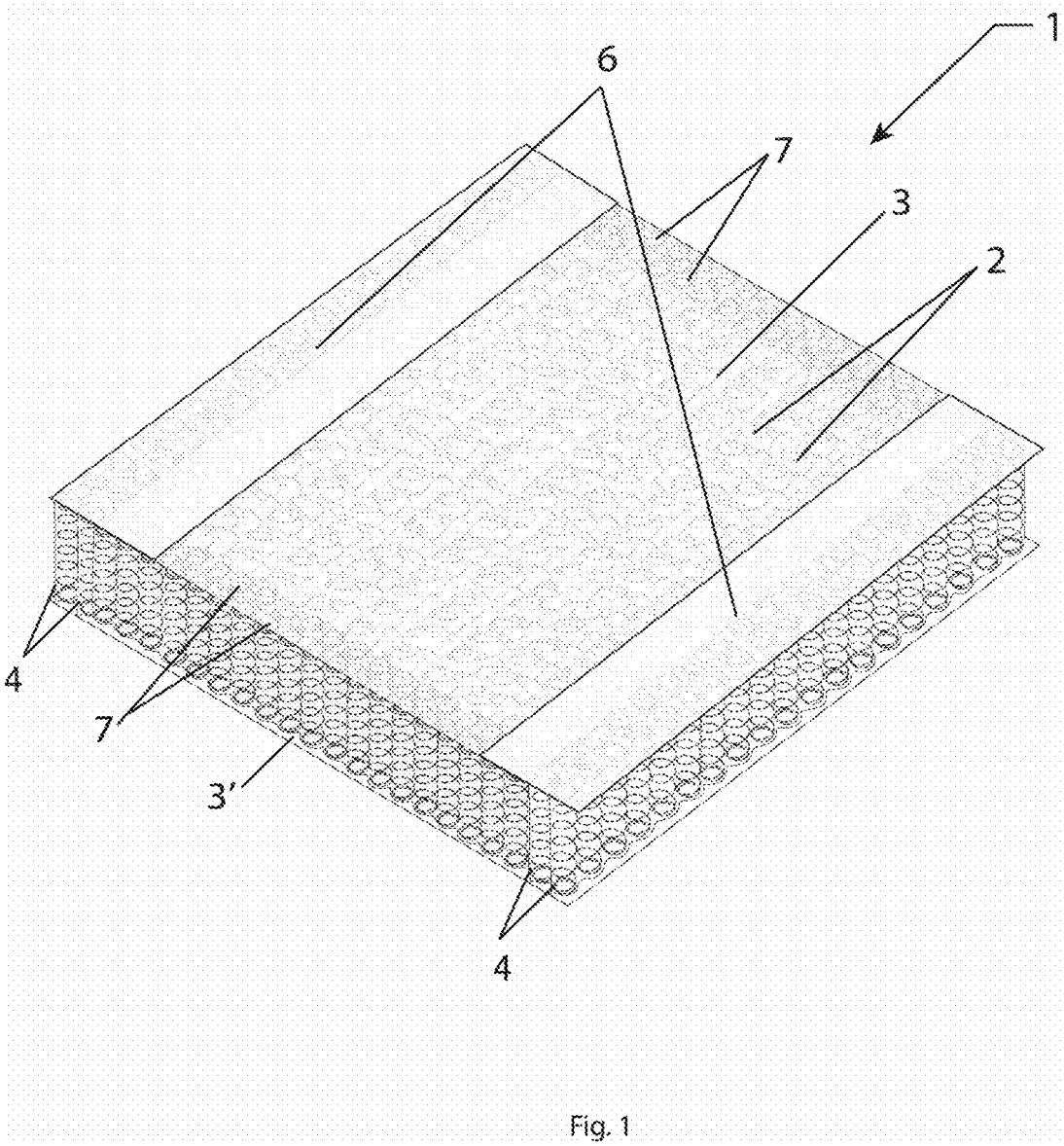
FIG. 1 shows in perspective view a pocket spring assembly in a preferred embodiment of the invention.

FIG. 1 shows in an embodiment a pocket spring assembly 1 which has a plurality of first pocket spring webs 2, a first layer 3 and a second layer 3' of textile material, second pocket spring webs 4, a strip 6 of textile material and third pocket spring webs 7.

Figure 2:
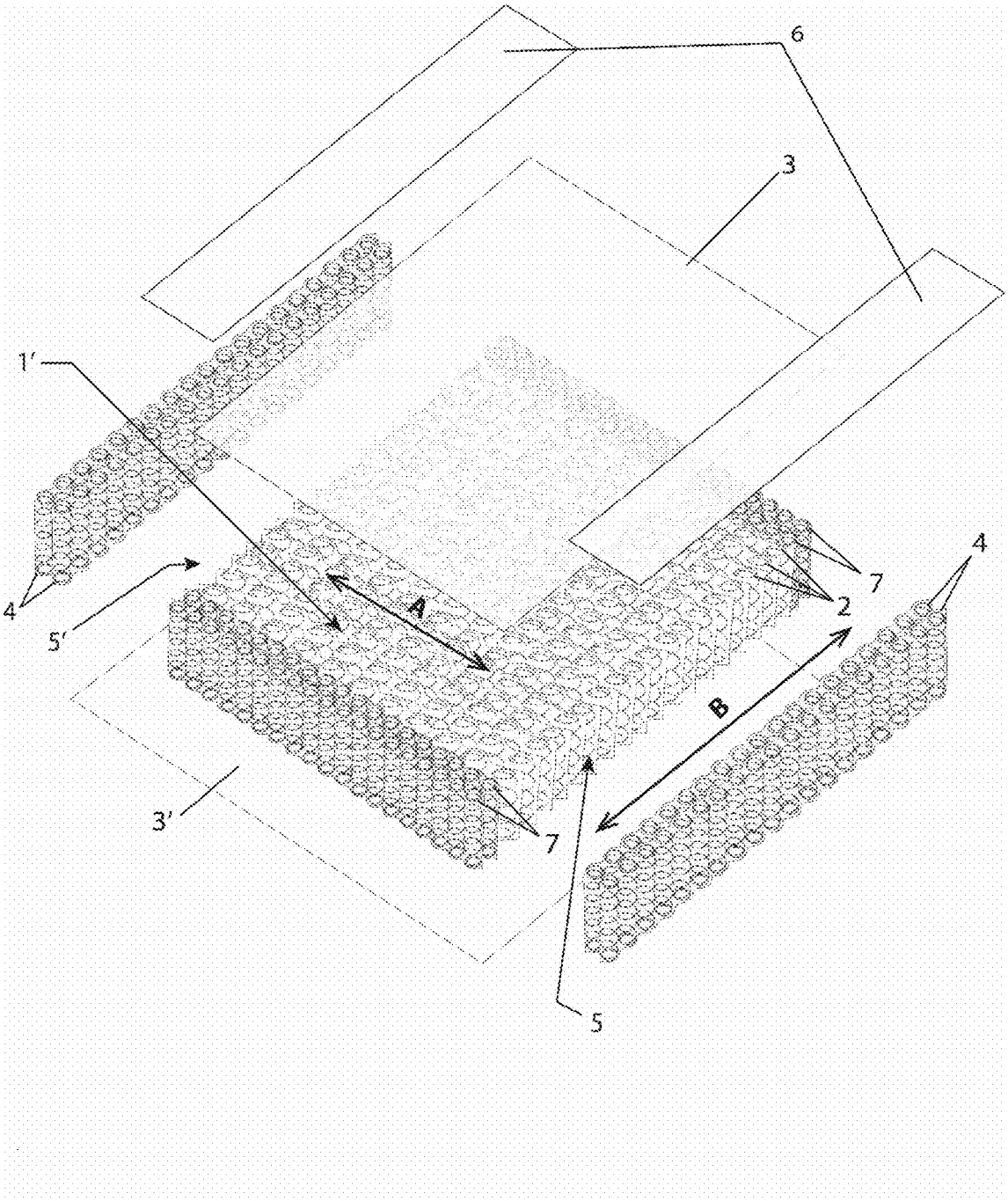
FIG. 2 shows in exploded view, in a preferred embodiment of the invention, a pocket spring assembly according to FIG. 1.

As is better illustrated in the exploded view of FIG. 2, a plurality of adjacent first pocket spring webs 2 are attached to each other along the direction, in which they are arranged (the direction in which first webs 2 extend, in other words the direction of the first webs 2, is indicated by an arrow in the drawing as an A). The plurality of pocket spring webs 2 connected together form the core 1' of the pocket spring assembly. FIG. 2 also shows a first layer 3 and a second layer 3' of textile material, second pocket spring webs 4 (joined together to form a set of two second pocket spring webs 4), strips 6 of textile material and third pocket spring webs 7, all of which are schematically shown in the view prior to being joined to form the pocket spring assembly. FIG. 2 also shows the lateral surfaces (5,5') to which the second webs 4 are attached so that they extend in the longitudinal direction B of the core 1', as indicated by the arrow in the drawing. As can be seen from the drawing, the longitudinal direction B (coinciding with the direction in which of the second webs 4 of the pocket spring assembly extend) is perpendicular to the direction A in which the first pocket springs webs 2 extend. The longitudinal direction B of the core 1' of the pocket spring assembly is the same direction in which the first pocket springs webs 2 are attached to each other to form the core 1'.

As also shown in FIG. 2, at both ends of the core 1' in the longitudinal direction B (hereinafter longitudinal ends of the core 1') third pocket springs webs 7 are connected to the first pocket springs webs 2, wherein the first webs 2 and the third webs 7 have the same web direction (direction A indicated by an arrow). As shown in the drawing, the second webs 4 and third webs 7 of the pocket springs have a different spring geometry than that provided in the first pocket springs webs 2. The second webs 4 and third webs 7 differ in their stiffness characteristics from the first webs 2, providing stiffening of the edges of the spring assembly in the embodiment shown in the drawing.

Using the FIGS. 3-9 as an example, an exemplary embodiment of the method steps according to the invention will now be presented.

Figure 3:
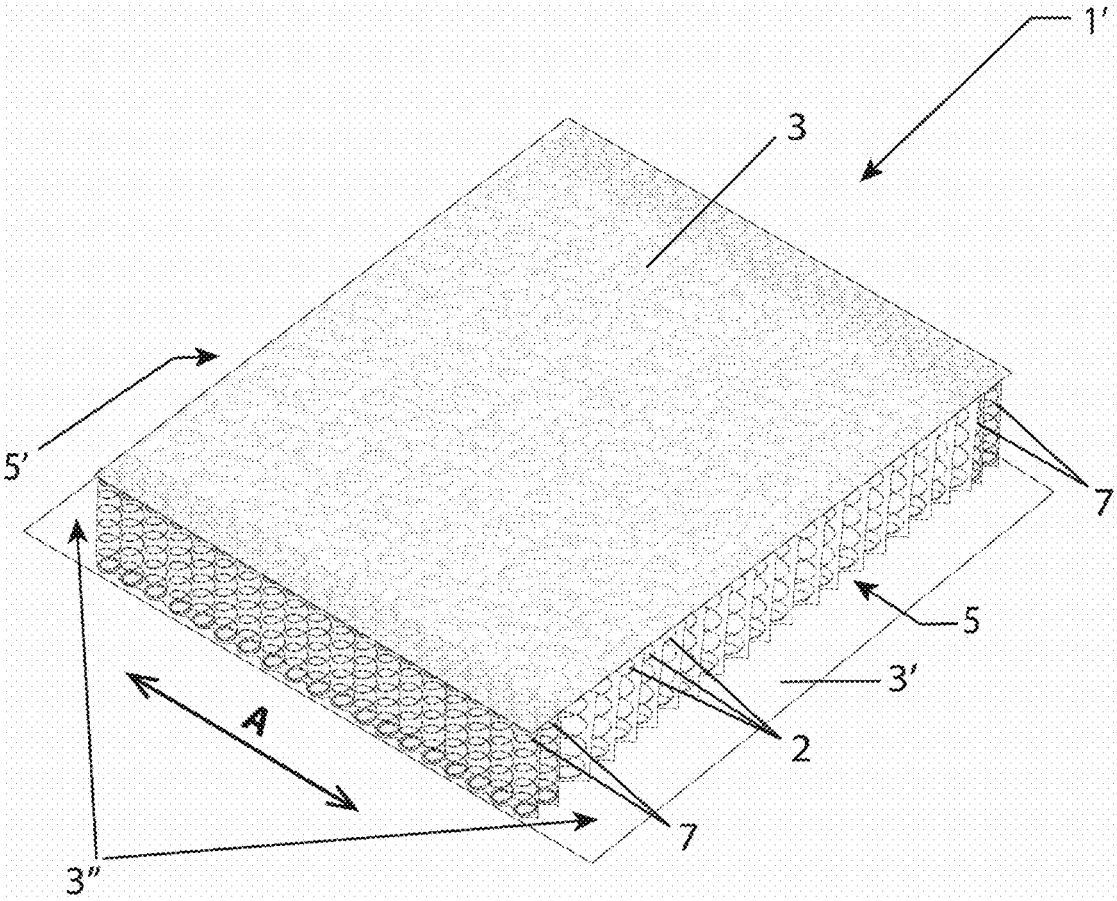
FIG. 3 shows in perspective view in a preferred embodiment of the invention the core of a pocket spring assembly with first and second textile layers placed on the first and second surfaces of the core.

FIG. 3 shows a schematic representation of a core 1' of a pocket spring assembly provided in step a) of the method, wherein the core 1' of the pocket spring assembly comprises a plurality of first pocket spring webs 2, wherein adjacent first pocket spring webs 2 are connected to each other. The connection of the webs 2 can be realized, for example, by gluing them to each other along the direction A in which they extend (as indicated by an arrow in the drawing). In this embodiment, the core is provided with third pocket spring webs 7 glued to the longitudinal ends of the core (1'). By differentiating the geometry of the springs contained in the pockets of the third pocket spring webs 7 with respect to the springs in the first webs 2, the longitudinal ends of the core 1' are stiffened.

As also shown in FIG. 3, a first layer 3 of textile material and a second layer 3' of textile material are attached (e.g. by gluing) respectively to a first and second surface of the core 1' (here lower and upper), wherein, as shown in the drawing, first layer 3 of textile material extends along the entire area of said first surface and essentially does not extend beyond its perimeter while second layer 3' has part 3" extending beyond the core 1' of the pocket spring assembly.

Figure 4:
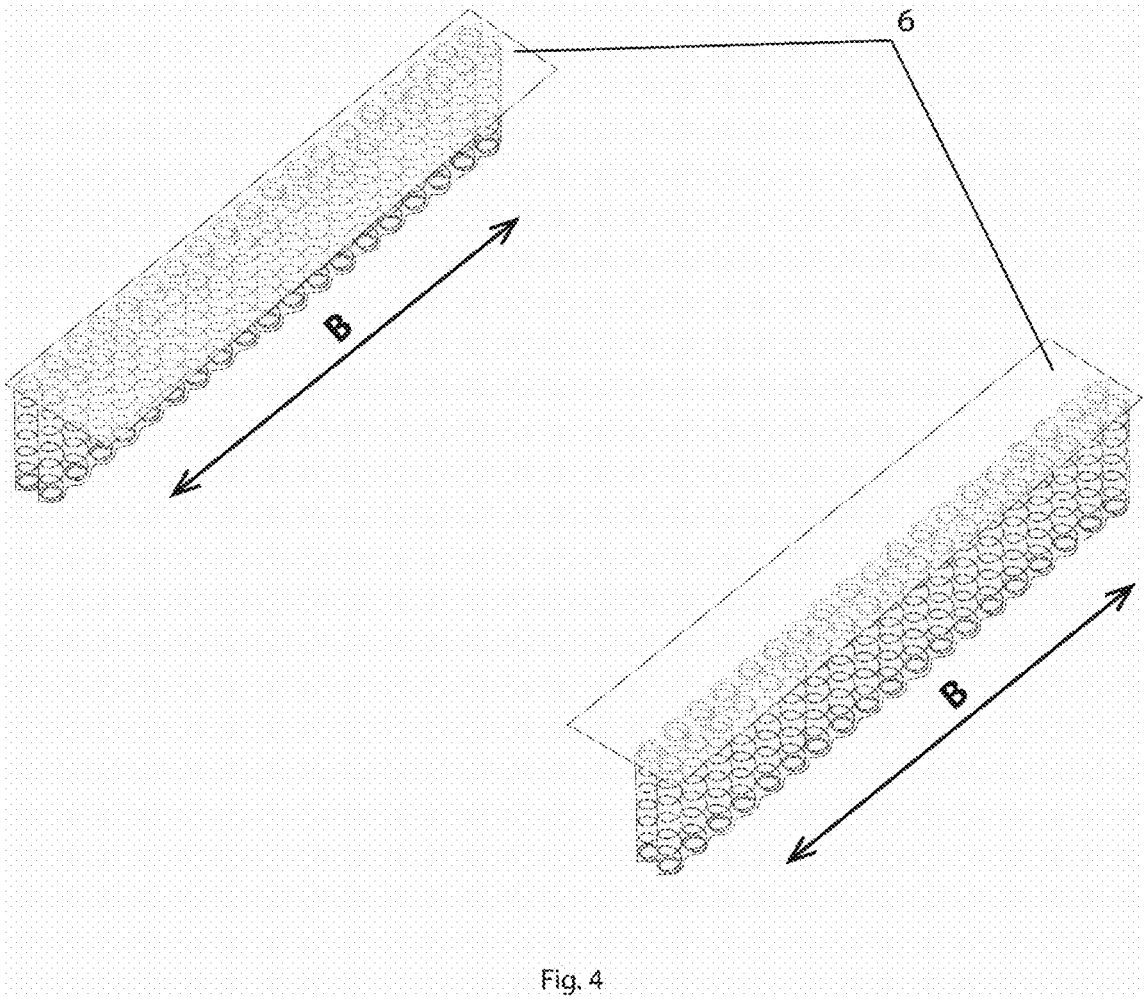
FIG. 4 shows, in a perspective view in a preferred embodiment, the strips of a pocket spring assembly attached to second pocket spring webs.
Figure 5:
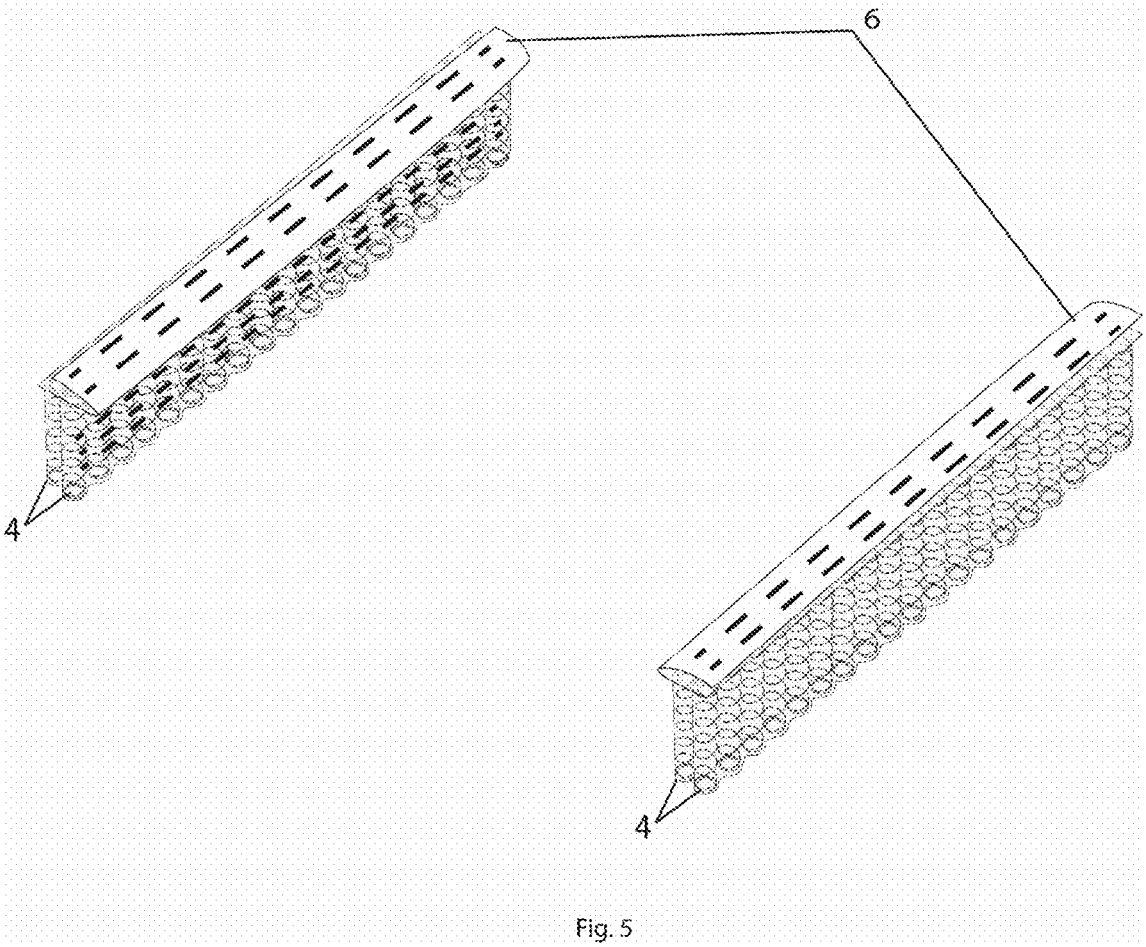
FIG. 5 shows, in a perspective view In a preferred embodiment, a step of the method before two pocket spring assembly webs according FIG. 4 are attached to lateral surfaces of the core.

FIG. 4 shows schematically strips 6 attached to the upper surface of the second pocket spring webs 4 (in a plane parallel to the plane of the first layer 3 of textile material, not shown in FIG. 4), wherein, as can be seen in the drawing, the textile strip 6 is arranged so that after attachment to the webs 4 it has an unattached part extending beyond the surface where it is attached to least one second pocket spring web 4. As shown in FIG. 5, said unattached parts of strip 6 extending beyond the attachment surface to webs 4 can be unwound so as to apply lines of glue (indicated by a dashed line) to the surfaces of the strip intended for attachment to the textile layer 3 of the core 1' (as better shown in FIG. 7). The side surfaces of the second pocket spring webs 4 which will be attached to the lateral surfaces 5,5' of the core 1' are also provided with lines of glue (due to perspective limitations shown as dashed lines on one side only).

Figure 6:
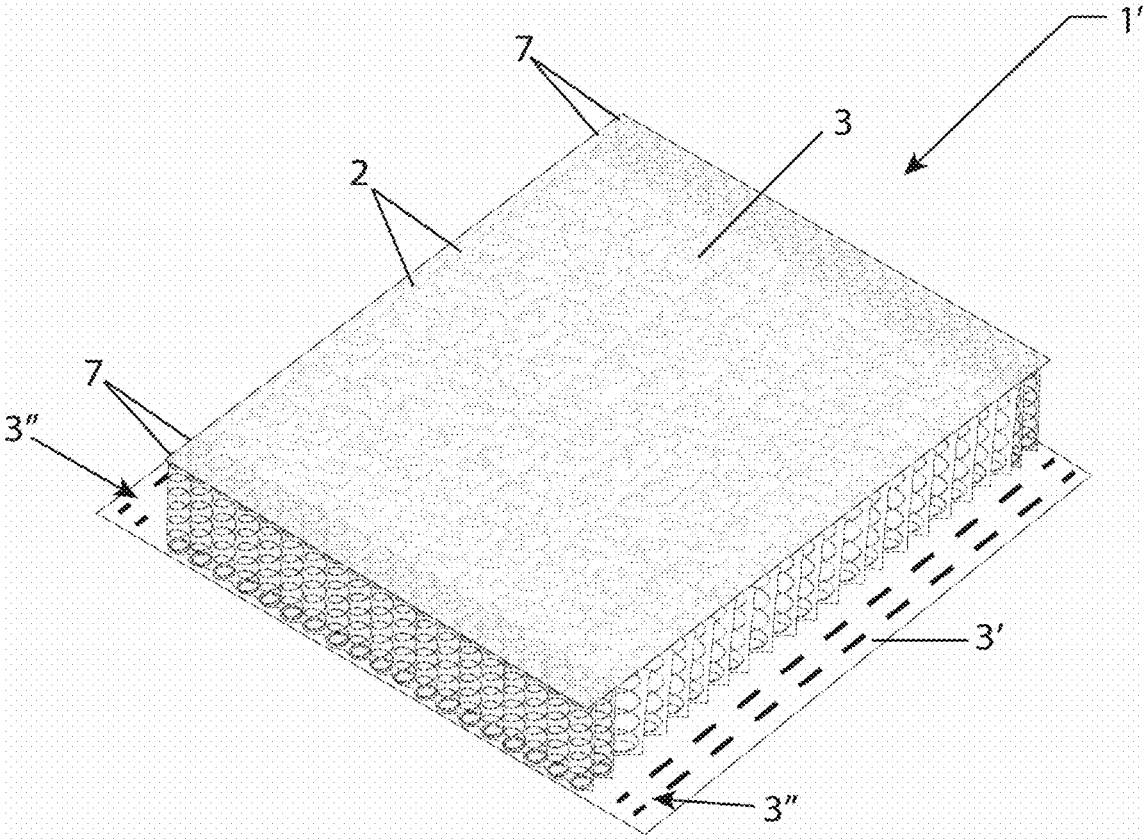
FIG. 6 shows, in a perspective view, core of the pocket spring assembly according FIG. 3 in step of the method before attaching the second pocket spring webs according to FIG. 4 to the lateral surfaces of the core.

FIG. 6 schematically illustrates the step of forming the pocket spring assembly 1 before the second pocket spring webs 4 are connected to the core 1'. The drawing shows in dashed lines the application of glue lines to the extending parts 3" of the textile layer 3', which will enable the attachment of the second pocket spring webs 4 to said layer.

Figure 7:
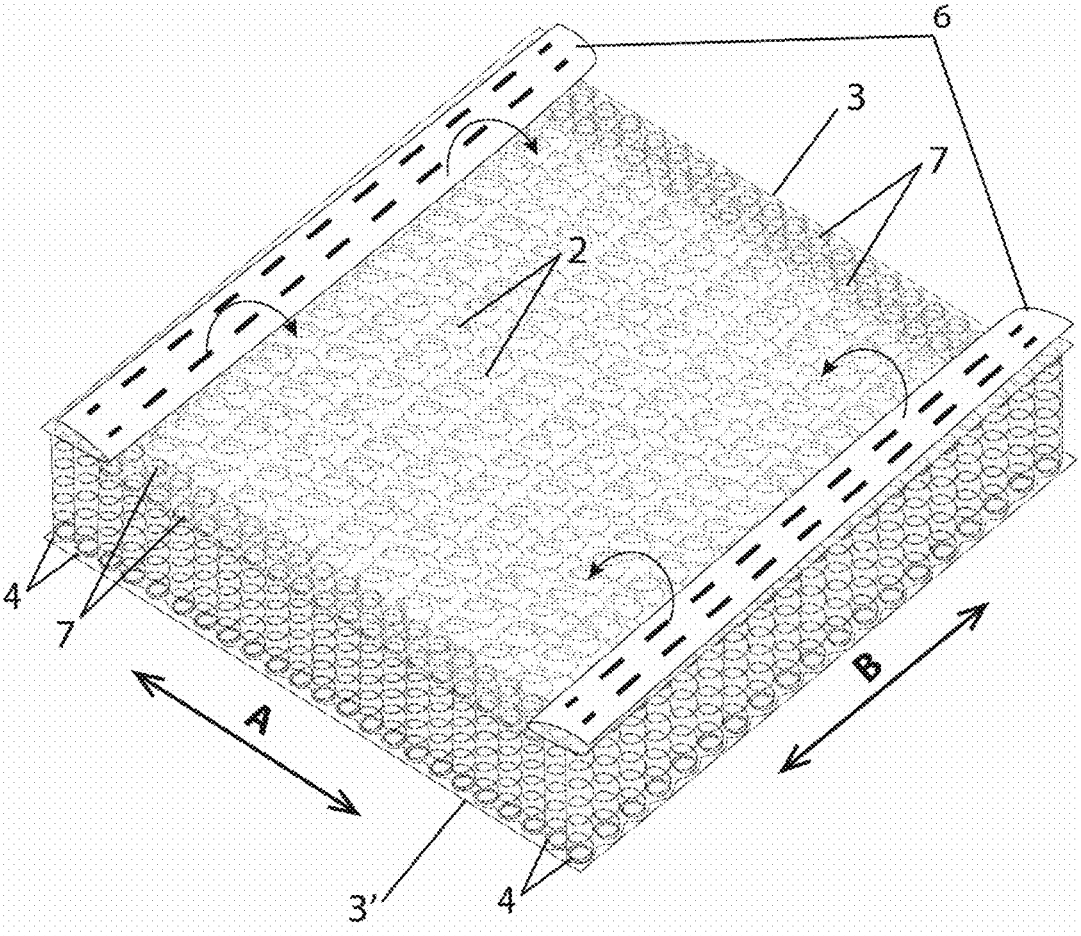
FIG. 7 shows, in a perspective view, a step of the method after the second pocket spring webs have been attached to the lateral surfaces of the core of the pocket spring assembly and before attaching the strips to the first layer of textile material.

FIG. 7 shows a pocket spring assembly 1 formed by attaching second pocket spring webs (4) to the lateral surfaces of a core (1') of the pocket spring assembly (shown in FIG. 6) and to portions of the textile layer 3' extending beyond the core (1) of the pocket spring assembly (portions 3" shown in FIG. 6). As shown in the drawing, the second pocket spring webs (4) extend in a direction B perpendicular to the direction A of the first and third pocket spring webs (2, 7).

At this stage, the textile strips 6 are unwound and attached to the textile layer 3, in the direction of the arrows, to obtain a finished pocket spring assembly 1, as shown in FIG. 1.

The solution according to the invention is an effective, simpler and cheaper alternative to reinforcing the edge of the pocket spring assembly compared to solutions known in the art. Attaching strips at the same time connecting the second pocket spring webs and the first layer of textile material not only provides effective reinforcement of the edge, but also significantly improves and stabilizes the shape of the corners, which becomes more filled and shapely. Depending on the configuration of the strips used and the geometry of the springs, the solution according to the invention allows for providing different comfort/stiffness zones in the middle and outer part of the mattress layer. Regardless of the above advantages, the production of the pocket spring assembly proposed by the invention can take place at reduced production costs compared to the production of the assemblies using known methods. In the embodiments shown in the drawing, a complete stiffening of the edge of the assembly is provided, by ensuring that the second pocket spring webs are glued on both sides of the core, which is also equipped with stiffening resulting from placing third pocket spring webs on the longitudinal ends of the core. It is clear to the person skilled in the art, however, that the scope of the invention also includes solutions in which only partial stiffening of the edge is provided, for example by adding only one second pocket spring web without adding third webs. In the embodiment shown, it is also provided for adding second and third pocket spring webs in sets of two webs. It is clear to the person skilled in the art that stiffening of the edge, depending on the needs, can also be achieved by adding single second and third webs, or by adding sets comprising more than two second and third webs. Each such solution is covered by the content of the following claims.

The invention claimed is:

1. A pocket spring assembly comprising:

a plurality of first pocket spring webs, wherein adjacent first pocket spring webs are joined together to form a core of the pocket spring assembly, a first layer of textile material and a second layer of textile material attached to a first and second surface of the core of the pocket spring assembly, respectively, at least one second pocket spring web attached to a first lateral surface of said core of the pocket spring assembly, forming a pocket spring assembly, wherein said second pocket spring web extends perpendicularly to a direction of the first pocket spring webs, wherein springs in the first pocket spring webs have different stiffness characteristics than springs in said at least one second pocket spring web, a first strip of textile material which is attached to at least one said second pocket spring web and to the first layer of textile material, and the second layer of textile material has a part extending beyond the core of the pocket spring assembly to which is attached said at least one second pocket spring web.

2. The pocket spring assembly according to claim 1, wherein the core of the pocket spring assembly comprises longitudinal ends, and wherein one or more third pocket spring webs are arranged at one of the longitudinal ends of the core of the pocket spring assembly, wherein the springs in the third pocket spring webs have different stiffness characteristics than the springs in the first pocket spring webs.

3. The pocket spring assembly according to claim 1, wherein the core of the pocket spring assembly comprises opposed longitudinal ends, and wherein one or more third pocket spring webs are arranged at both longitudinal ends of the core of the pocket spring assembly, wherein the springs in the third pocket spring webs have different stiffness characteristics than the springs of the first pocket spring webs.

4. The pocket spring assembly according to claim 1, wherein a set of two second pocket spring webs is attached to the first strip of textile material and to the first layer of textile material and to the part of the second layer of textile material extending beyond the core of the pocket spring assembly.

5. The pocket spring assembly according to claim 1, wherein the pocket spring assembly comprises one or more second pocket spring webs, attached to a second lateral surface of the core of the pocket spring assembly, wherein the second layer of textile material has a second part extending beyond the core of the pocket spring assembly to which one or more second pocket spring webs attached to the second side surface, and an additional second first strip of textile material is attached to one or more second pocket spring webs attached to the second side surface and to the first layer of textile material.

6. A mattress comprising a pocket spring assembly according to claim 1.

7. A method of manufacturing a pocket spring assembly comprising the steps of:

a) providing a core of the pocket spring assembly, wherein said core of the pocket spring assembly comprises a plurality of first pocket spring webs, wherein adjacent first pocket spring webs are joined together to form said core of the pocket spring assembly, b) attaching a first layer of textile material and a second layer of textile material to first and second surfaces of said core of the pocket spring assembly, respectively, wherein the first layer of textile material covers the first surface of the pocket spring core and does not extend beyond a perimeter, while the second layer of textile material has a portion extending beyond the core of the pocket spring assembly, c) providing at least one second pocket spring web in which springs have different stiffness characteristics than springs in the first pocket spring webs, d) attaching a strip of textile material to said at least one second pocket spring web in a plane parallel to a plane of the first layer of textile material, wherein after attachment said strip of textile material has an unattached portion extending beyond a surface where said strip is attached to the at least one second pocket springs web, e) forming a pocket spring assembly by attaching said at least one second pocket spring web obtained in step (d) to a first lateral surface of the core of the pocket spring assembly so that said unattached extending part of the strip of textile material is attached to the first layer of textile material and, on an opposite side, said at least one second pocket spring web is attached to a part of the second layer of textile material extending beyond the core of the pocket spring assembly.

8. The method according to claim 7, wherein in step a) the core of the pocket spring assembly is provided with one or more third pocket spring webs attached to an outermost pocket spring web at a longitudinal end of the pocket spring assembly core, wherein springs in the third pocket spring web have different stiffness characteristics than the springs in the first pocket spring webs.

9. The method according to claim 7, wherein in step a) the core of the pocket spring assembly comprises one or more third pocket spring webs attached to the outermost pocket spring webs at both longitudinal ends of the core of the pocket spring assembly, springs in the third pocket spring web having different stiffness characteristics than the springs in the first pocket spring webs.

10. The method according to claim 7, wherein in step b) the second layer of textile material has two opposite portions extending beyond a perimeter of the core of the pocket spring assembly, and in step e) one or more second pocket spring webs obtained in accordance with step, are additionally attached to a second lateral surface of the core of the pocket spring assembly, such that said unattached extending portion of the strip of textile material is attached to the first layer of textile material, and on the opposite side at least one second pocket spring web is attached to a portion of the second layer of textile material extending beyond the core of the pocket spring assembly.

* * * * *